US009517880B2

(12) United States Patent
Chang

(10) Patent No.: US 9,517,880 B2
(45) Date of Patent: Dec. 13, 2016

(54) SYSTEM FOR AUTOMATICALLY CONTAINING LEAKAGE OF LIQUID

(71) Applicant: Kuo-Chi Chang, New Taipei (TW)

(72) Inventor: Kuo-Chi Chang, New Taipei (TW)

(73) Assignee: Kuo-Chi Chang, New Taipei (TW)

( * ) Notice: Subject to any disclaimer, the term of this patent is extended or adjusted under 35 U.S.C. 154(b) by 0 days.

(21) Appl. No.: 14/873,851

(22) Filed: Oct. 2, 2015

(65) Prior Publication Data

US 2016/0096683 A1 Apr. 7, 2016

(30) Foreign Application Priority Data

Oct. 7, 2014 (TW) ..... 10 3217831

(51) Int. Cl.
*F16K 99/00* (2006.01)
*B65D 90/24* (2006.01)

(52) U.S. Cl.
CPC ..... *B65D 90/24* (2013.01)

(58) Field of Classification Search
CPC ... B65D 90/0033; B65D 90/24; B67D 7/3209; Y10T 137/4824; Y10T 137/5762; E04B 1/3431; E04B 1/34305; E04B 2001/34394
USPC 137/236.1, 312, 356, 363, 370; 220/560.03, 567.1, 565; 49/131, 132, 133
See application file for complete search history.

(56) References Cited

U.S. PATENT DOCUMENTS 5,114,046 A * 5/1992 Bryant ..... B60S 5/02 137/234.6
8,893,433 B2 * 11/2014 Fukagawa ..... E06B 11/025 49/10
2003/0192253 A1 * 10/2003 Miller ..... E01F 13/046 49/49
2013/0140304 A1 * 6/2013 Mackie ..... B65D 90/24 220/4.01
2013/0334222 A1 * 12/2013 Elliot ..... B65D 21/086 220/4.12

* cited by examiner

*Primary Examiner* — Reinaldo Sanchez-Medina
(74) *Attorney, Agent, or Firm* — Brinks Gilson & Lione; John C. Bacoch

(57) ABSTRACT

A system for automatically containing leakage of liquid from a reservoir includes a surrounding wall, a driving unit, a sensor and a controller unit. The driving unit is configured to drive the surrounding wall to move between containing and non-containing positions. The sensor is capable of generating a detection signal. The controller unit receives the detection signal, and determines whether leakage of liquid from the reservoir has occurred. When it is determined that the leakage of liquid from the reservoir has occurred, the driving unit is actuated by the controller unit to drive the surrounding wall to move from the non-containing position to the containing position for containing the leakage of liquid.

13 Claims, 5 Drawing Sheets

SYSTEM FOR AUTOMATICALLY CONTAINING LEAKAGE OF LIQUID

CROSS-REFERENCE TO RELATED APPLICATION

This application claims priority of Taiwanese Application No. 103217831, filed on Oct. 7, 2014.

FIELD

The disclosure relates to a system for automatically containing leakage of liquid from, for example, a reservoir.

BACKGROUND

Conventionally, in order to contain leakage of liquid-state chemical substance from a reservoir, an enclosing wall is built on the ground to enclose the reservoir, defining a receiving space. However, the enclosing wall may prove a source of inconvenience when the reservoir is required to be replaced. In such cases, a to-be-replaced reservoir has to be lifted above the enclosing wall in order to be removed from the receiving space, and a new reservoir has to be lifted above the enclosing wall in order to be placed into the receiving space. In another case where the reservoir needs to be maintained, the person who is performing the maintenance has to climb over the enclosing wall, bringing along the necessary equipment.

SUMMARY

Therefore, an object of the disclosure is to provide a system that can alleviate at least one of the drawbacks of the prior arts.

According to the disclosure, a system is for automatically containing leakage of liquid from a reservoir. The system includes a surrounding wall, a driving unit, a sensor and a controller unit.

The surrounding wall is operable to move between a containing position, in which the surrounding wall encloses the reservoir, and a non-containing position, in which the reservoir is unenclosed by the surrounding wall.

The driving unit is configured to drive the surrounding wall to move between the containing position and the non-containing position.

The sensor is to be disposed around the reservoir. The sensor is capable of generating a detection signal.

The controller unit is coupled to the sensor to receive the detection signal therefrom. The controller unit is configured to determine whether leakage of liquid from the reservoir has occurred based on the detection signal, and to actuate the driving unit to drive the surrounding wall to move from the non-containing position to the containing position for containing the leakage of liquid when it is determined that the leakage of liquid from the reservoir has occurred.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
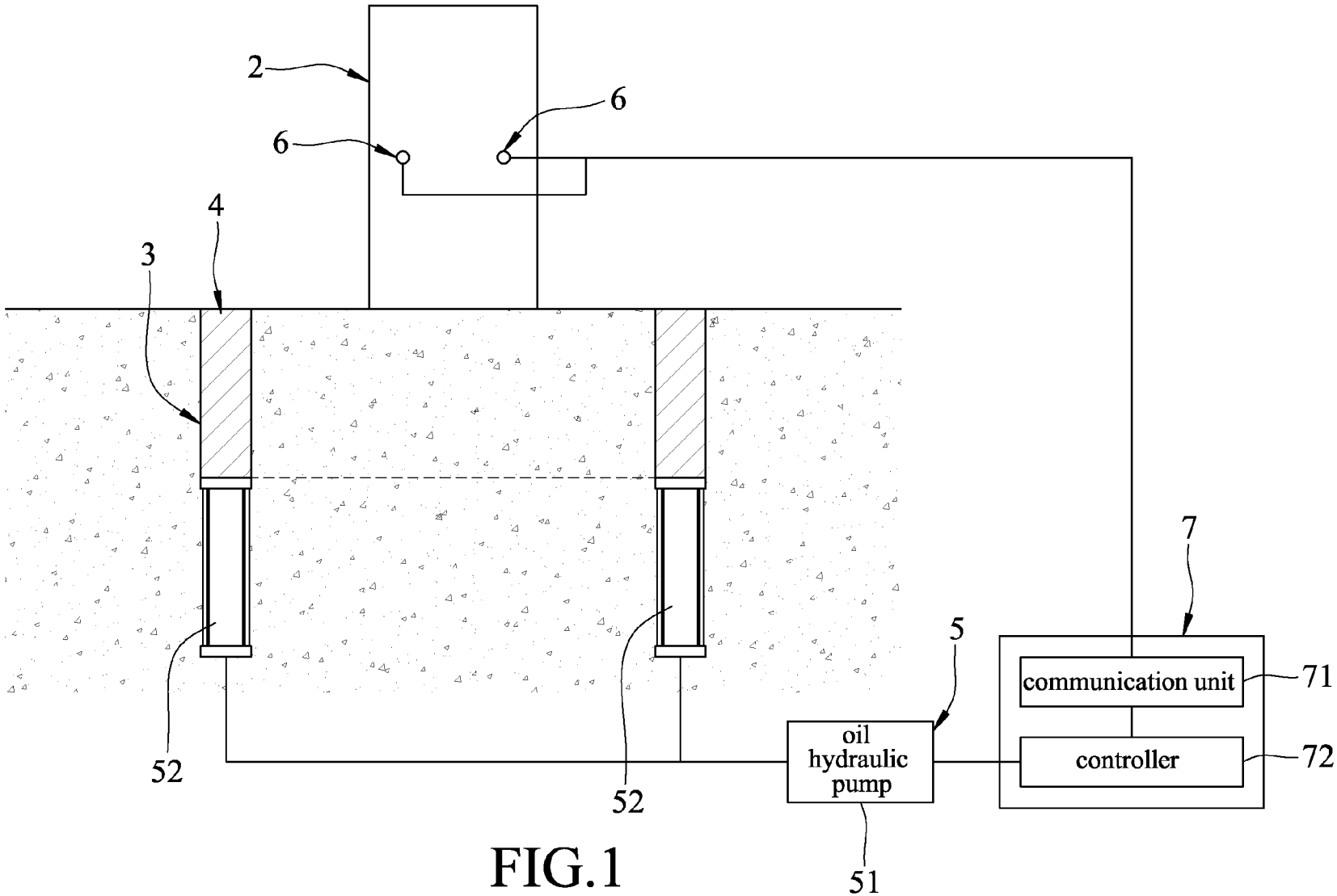
FIG. 1 illustrates a first embodiment of a system for automatically containing leakage of liquid from a reservoir according to the disclosure, where a surrounding wall is in a non-containing position.

Before the disclosure is described in greater detail, it should be noted that like elements are denoted by the same reference numerals throughout the disclosure.

FIG. 1 illustrates the first embodiment of a system for automatically containing leakage of liquid from a reservoir 2. In this embodiment, the reservoir 2 is for storing liquid chemical substance therein, and has a capacity of 5000 liters.

The system includes a receiving structure 3, a surrounding wall 4, a driving unit 5, two sensors 6 and a controller unit 7.

In this embodiment, the receiving structure 3 defines a receiving slot, is configured to be embedded in the ground and to surround the reservoir 2, and is circularly shaped. In this embodiment, the receiving slot is formed directly in the ground.

The surrounding wall 4 is operable to move relative to the receiving structure 3 between a containing position, in which the surrounding wall 4 encloses the reservoir 2, and a non-containing position, in which the reservoir 2 is unenclosed by the surrounding wall 4. The surrounding wall 4 may be made of one of a plastic material, a stone material (e.g., dimension stone) and a metal material.

When in the containing position, the surrounding wall 4 and the ground cooperatively define a containing space. In order to ensure that the liquid chemical substance does not flow out of the containing space, it is beneficial to size the surrounding wall 4 such that a volume of the containing space is larger than at least 1.1 times a volume of the reservoir 2. In this embodiment, the surrounding wall 4 is a solid wall made of a metal material and is hollow cylinder-shaped. The surrounding wall 4 has a thickness of 3 centimeters, a diameter of 380 centimeters, a height of 50 centimeters, making the volume of the containing space 5670.5 liters (approximately 1.13 times the volume of the reservoir 2 of this embodiment).

In other embodiments, the surrounding wall 4 may be made in various shapes as long as the resulting volume of the containing space is larger than 5500 liters if the volume of the reservoir 2 is 5000 liters. Additionally, the surrounding wall 4 may al so be a hollow wall made of, e.g., a plastic material and being hollow cylinder-shaped (and optionally filled with water to enhance endurance of lateral pressure); in this case the thickness must exceed 10 centimeters.

Figure 2:
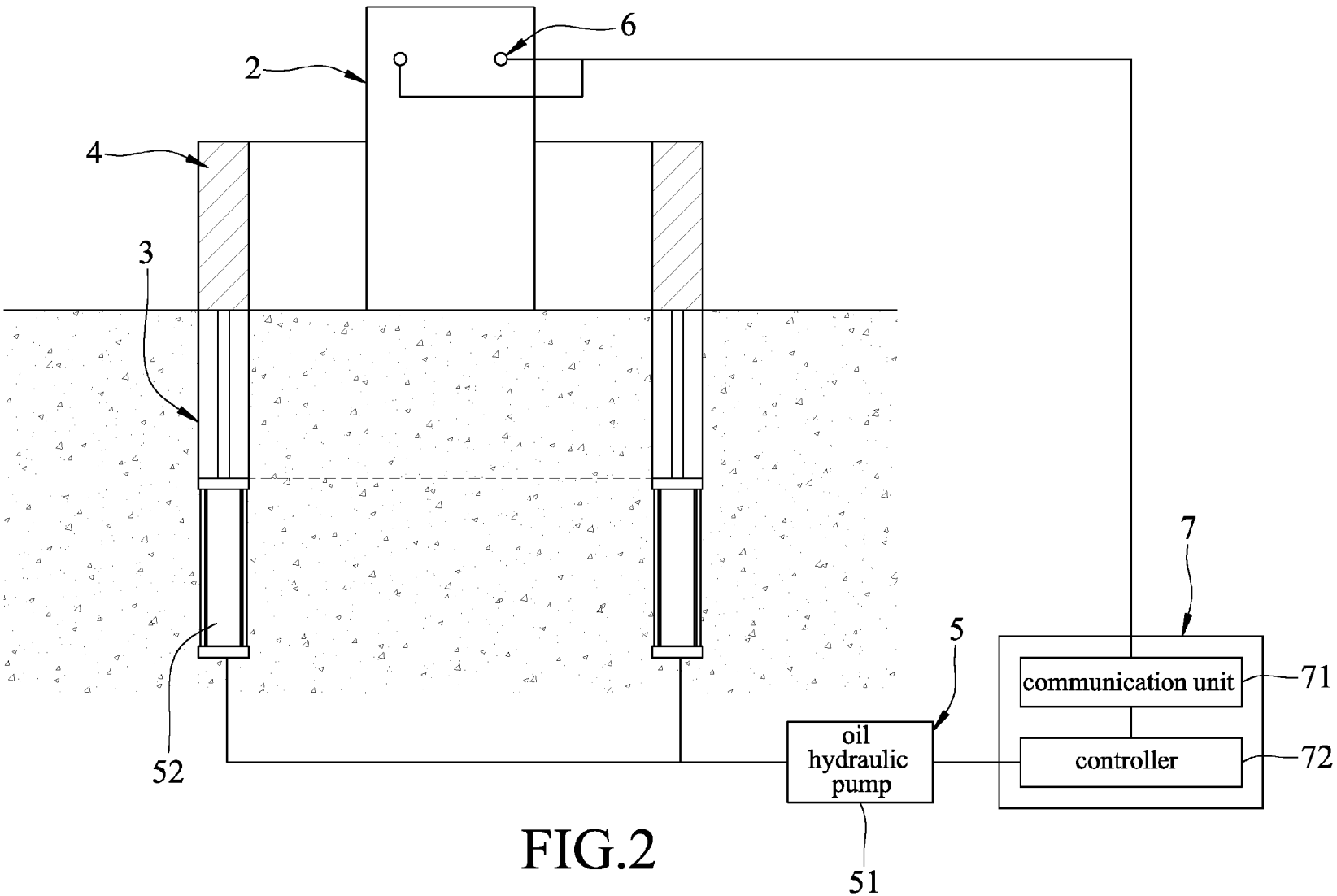
FIG. 2 illustrates the first embodiment, where the surrounding wall is in a containing position.

The driving unit 5 is connected to the surrounding wall 4 in order to drive the movements thereof. In particular, the driving unit 5 is configured to drive the surrounding wall 4 to move between the non-containing position (see FIG. 1, where the surrounding wall 4 is disposed entirely in the receiving structure 3) and the containing position (see FIG. 2, where the surrounding wall 4 is moved upwardly relative to and from the receiving structure 3).

In this embodiment, the driving unit 5 is a linear actuator. In particular, the driving unit 5 includes an oil hydraulic pump 51 and two hydraulic cylinders 52. The hydraulic cylinders 52 are disposed in the receiving structure 3 below the surrounding wall 4 for lifting the surrounding wall 4 to the containing position. In this embodiment, the hydraulic cylinders 52 are disposed at two locations in the receiving structure 3 such that a straight line interconnecting the hydraulic cylinders 52 equals a diameter of the receiving structure 3.

The oil hydraulic pump 51 is coupled to the hydraulic cylinders 52 for pumping the hydraulic cylinders 52.

The sensor 6 is to be disposed around the reservoir 2. In this embodiment, two sensors 6 are disposed directly on an outer surface of the reservoir 2, and additional sensor(s) may be employed at various locations.

The sensors 6 are capable of generating a detection signal. In particular, the sensors 6 may be embodied using analog resistive sensors including two electrically conductive objects and a via hole disposed therebetween. When no leakage occurs, the sensors 6 are non-conducting, generating no signal.

On the other hand, in case of leakage, the liquid chemical substance flows out from the reservoir 2 and covers the sensors 6. As a result, the sensors 6 become conducting and therefore are able to generate the detection signal (indicating that leakage occurs).

In other embodiments, various sensors may be employed for detecting leakage, such as an optical sensor, an audio frequency sensor, an electrical sensor, a conduction sensor, etc.

The controller unit 7 is coupled to the sensors 6. In this embodiment, the sensors 6 are connected to the controller unit 7 by electrical wires. In other embodiments, the coupling between the sensors 6 and the controller unit 7 may be implemented using a wireless connection.

The controller unit 7 includes a communication unit 71 for receiving the detection signal from the sensors 6, and a controller 72 coupled to the communication unit 71 for receiving the detection signal therefrom and actuating the driving unit 5.

The controller unit 7 determines whether leakage of liquid from the reservoir 2 has occurred based on the detection signal. In this embodiment, when the detection signal is received from the sensors 6, the controller 72 determines that leakage of the liquid chemical substance from the reservoir 2 has occurred.

When it is determined that leakage of the liquid chemical substance from the reservoir 2 has occurred, the controller 72 is configured to actuate the driving unit 5 to drive the surrounding wall 4 to move from the non-containing position to the containing position for containing the leakage of liquid.

One advantage of this embodiment is that, in the absence of leakage of liquid, the surrounding wall 4 is disposed at the non-containing position, and is entirely received in the receiving structure 3. This configuration eliminates the drawbacks brought about by having the surrounding wall 4 disposed at the containing position all times. For example, maintenance personnel can easily access the reservoir 2 when the surrounding wall 4 is in the non-containing position.

Figure 3:
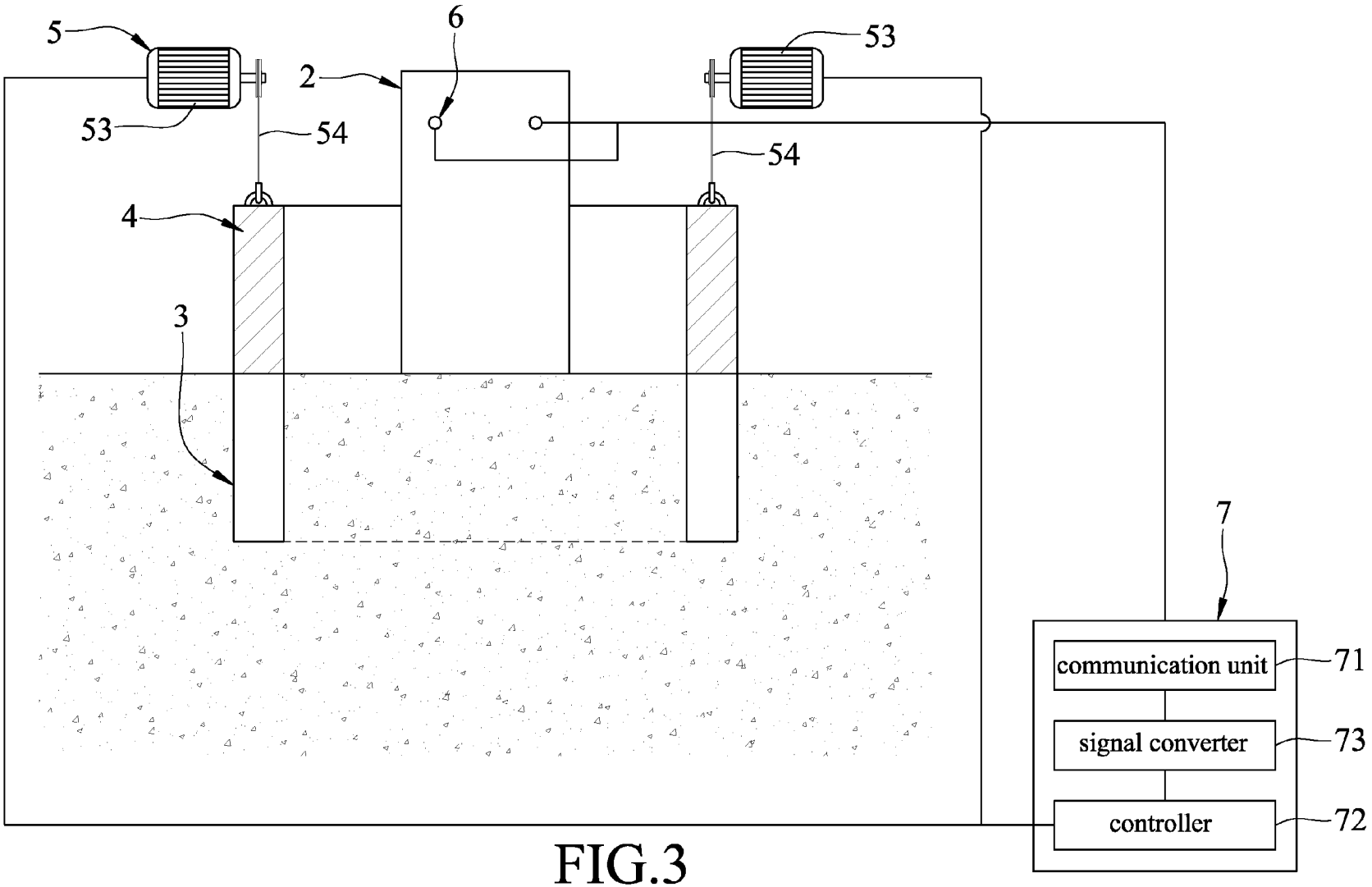
FIG. 3 illustrates a second embodiment of a system for automatically containing leakage of liquid from a reservoir according to the disclosure.

FIG. 3 illustrates a system for automatically containing leakage of liquid from the reservoir 2 according to a second embodiment of the disclosure.

In this embodiment, the driving unit 5 includes two hanger cables 54 connected to the surrounding wall 4, and two motors 53 connected respectively to the hanger cables 54. Here the motors 53 may be embodied using hoist motors.

In operation, the controller unit 7 actuates the motors 53 in response to the detection signal, and the motors 53 are configured to pull up the hanger cables 54 when actuated by the controller unit 7, lifting the surrounding wall 4.

The incorporation of this configuration allows the surrounding wall 4 to be lifted faster. However, a maximum load of the hanger cables 54 may be limited, and the surrounding wall 4 may require different design to have a lower weight (e.g., adopt plastic material in building the surrounding wall 4).

The controller unit 7 in this embodiment may further include a signal converter 73. The signal converter 73 includes at least one of an analog-to-digital converter (ADC) and a digital-to-analog converter (DAC). The signal converter 73 converts the detection signal into a form that can be processed by the controller 72.

Figure 4:
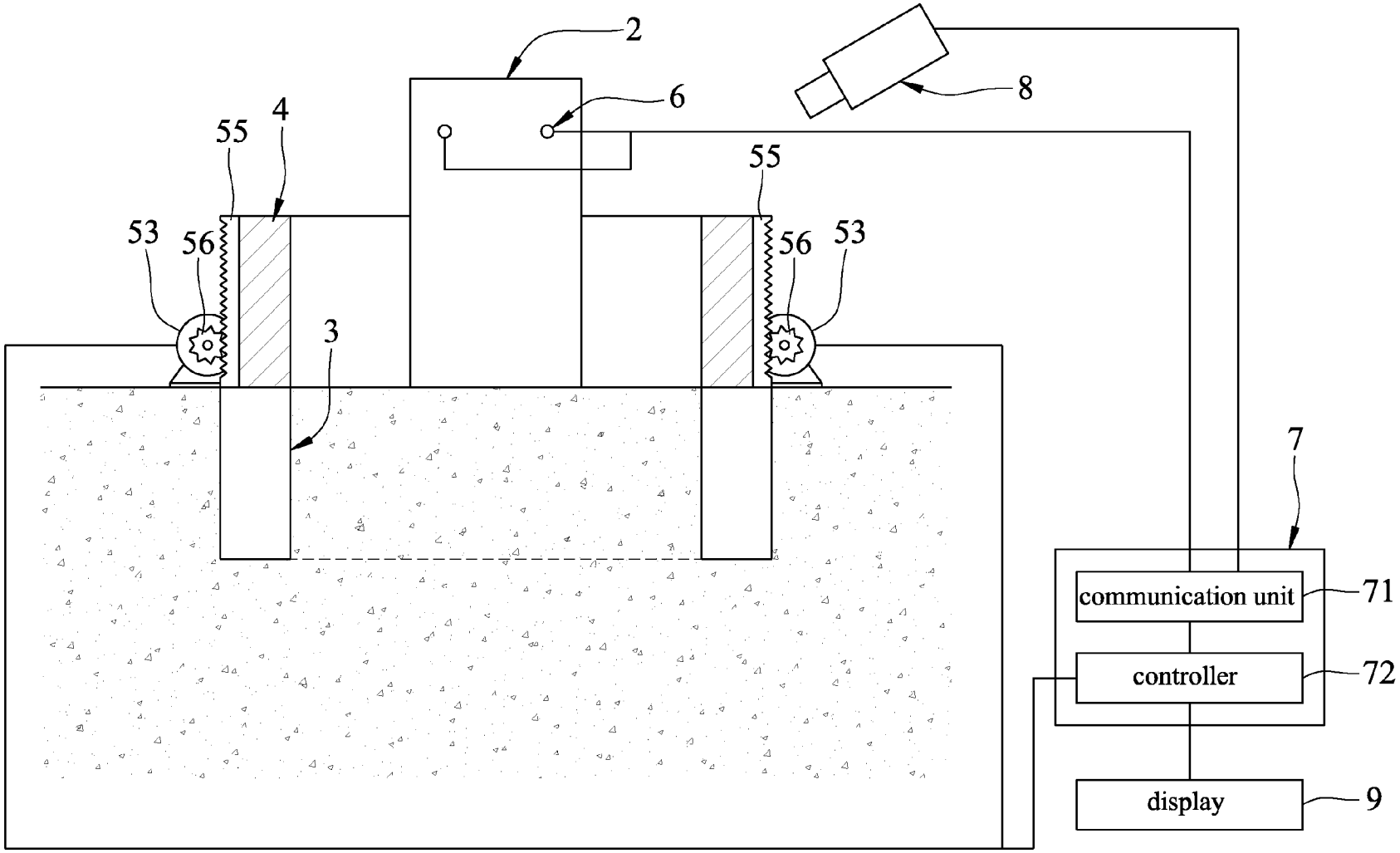
FIG. 4 illustrates a third embodiment of a system for automatically containing leakage of liquid from a reservoir, according to the disclosure.
Figure 5:
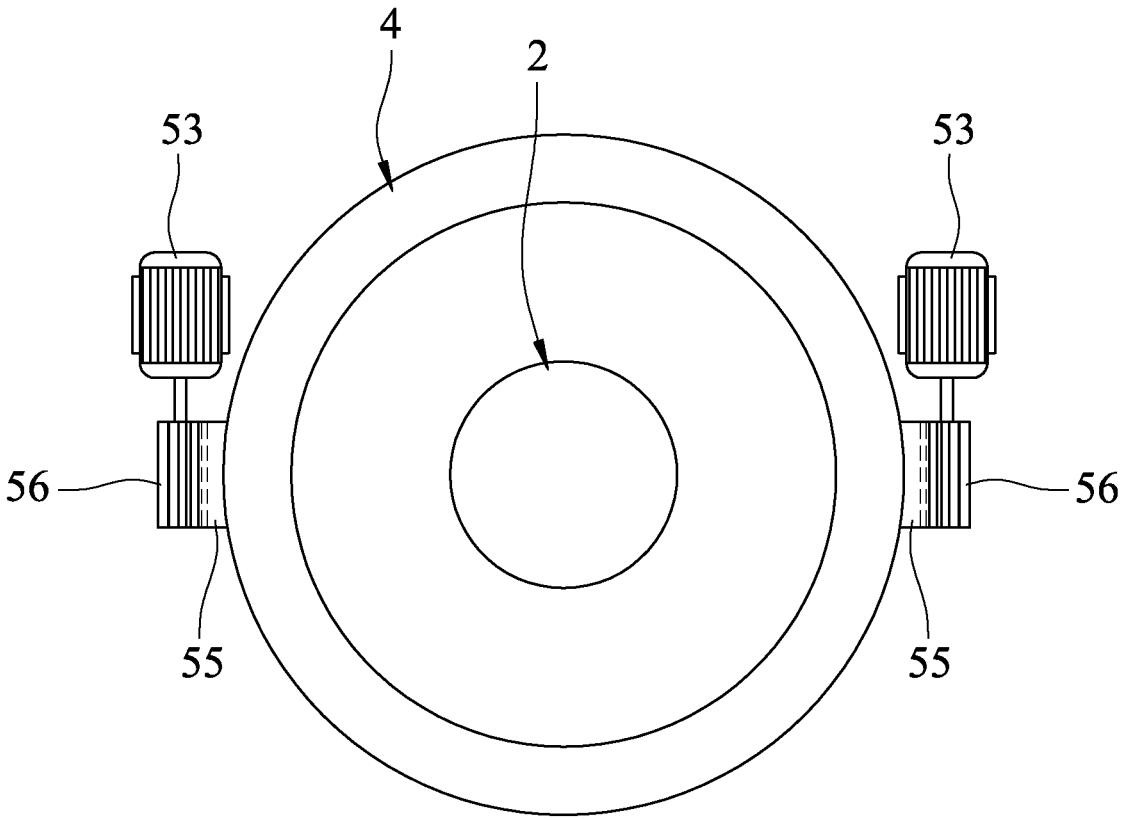
FIG. 5 is a top view of the third embodiment.

FIGS. 4 and 5 illustrate a system according to a third embodiment of the disclosure.

In this embodiment, the surrounding wall 4 is made by a dimension stone material. The driving unit 5 includes two racks 55, two pinion gears 56 respectively meshing the racks 55, and two motors 53 connected respectively to the pinion gears 56.

The racks 55 are fixedly disposed at two locations on the outer surface of the surrounding wall 4, such that a straight line interconnecting the racks 55 equals a diameter of the surrounding wall 4 (as illustrated in FIG. 5).

In operation, the controller unit 7 actuates the motors 53 in response to the detection signal, and the motors 53 are configured to respectively drive the pinion gears 56 to rotate when actuated, lifting the racks 55 together with the surrounding wall 4, bringing the surrounding wall 4 into the containing position.

The system may further include an image capturing unit 8 for capturing an image of the reservoir 2, and a display 9 for displaying the image of the reservoir 2. The image of the reservoir 2 may serve as an additional element for determining whether leakage of liquid occurs, and/or for determining whether the system is operating properly (e.g., whether the surrounding wall 4 is properly lifted in the occurrence of leakage).

In embodiments, the system may be coupled to other external systems for dealing with the leakage of liquid, such as a disaster prevention and response system.

To sum up, the system as described in the disclosure provides away for automatically placing the surrounding wall 4 in the containing position only when leakage of liquid occurs. In this way, operations regarding replacing or maintaining the reservoir 2 may be performed without experiencing the inconvenience brought by the surrounding wall 4 permanently disposed in the containing position.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A system for automatically containing leakage of liquid from a reservoir, said system comprising:

a surrounding wall operable to move between a containing position, in which said surrounding wall encloses the reservoir, and a non-containing position, in which the reservoir is unenclosed by said surrounding wall;

a driving unit configured to drive said surrounding wall to move between the containing position and the non-containing position;

a sensor to be disposed around the reservoir, said sensor being capable of generating a detection signal; and a controller unit coupled to said sensor to receive the detection signal therefrom, and configured to determine whether leakage of liquid from the reservoir has occurred based on the detection signal, and to actuate said driving unit to drive said surrounding wall to move from the non-containing position to the containing position for containing the leakage of liquid when it is determined that the leakage of liquid from the reservoir has occurred.

2. The system of claim 1, further comprising a receiving structure that has a receiving slot and that is configured to be embedded in a ground and to surround the reservoir, wherein, in the non-containing position, said surrounding wall is disposed entirely in said receiving slot of said receiving structure, and when actuated by said controller unit, said driving unit drives said surrounding wall to move upwardly relative to said receiving structure to the containing position.

3. The system of claim 2, wherein said driving unit includes:

at least one hydraulic cylinder disposed in said receiving slot of said receiving structure below said surrounding wall for lifting said surrounding wall to the containing position; and an oil hydraulic pump coupled to said at least one hydraulic cylinder, and configured to pump said at least one hydraulic cylinder when actuated by said controller unit, thereby lifting said surrounding wall.

4. The system of claim 2, wherein said driving unit includes:

at least one hanger cable connected to said surrounding wall; and at least one hoist motor connected to said at least one hanger cable, and configured to pull up said at least one hanger cable when actuated by said controller unit, thereby lifting said surrounding wall.

5. The system of claim 1, wherein said driving unit is a linear actuator.

6. The system of claim 5, wherein said driving unit includes:

a rack fixedly disposed at said surrounding wall;

a pinion gear meshing said rack; and at least one motor connected to said pinion gear, and configured to drive said pinion gear to rotate when actuated by said controller unit, thereby lifting said rack together with said surrounding wall.

7. The system of claim 1, further comprising an image capturing unit for capturing an image of the reservoir.

8. The system of claim 7, further comprising a display for displaying the image of the reservoir.

9. The system of claim 1, wherein said surrounding wall is made of one of a plastic material, a dimension stone material and a metal material.

10. The system of claim 1, wherein in the containing position, said surrounding wall and the ground cooperatively define a containing space, and a volume of the containing space is at least 1.1 times a volume of the reservoir.

11. The system of claim 1, wherein a coupling between said sensor and said controller unit is implemented by one of a wired connection and a wireless connection.

12. The system of claim 1, wherein said controller unit includes a communication unit for receiving the detection signal from said sensor, and a controller for actuating said driving unit based on the detection signal.

13. The system of claim 1, wherein said controller unit includes at least one of an analog-to-digital converter (ADC) and a digital-to-analog converter (DAC).

* * * * *